US008331533B2

(12) United States Patent
Yamamoto

(10) Patent No.: US 8,331,533 B2
(45) Date of Patent: Dec. 11, 2012

(54) X-RAY IRRADIATOR

(75) Inventor: Keiichiro Yamamoto, Yokohama (JP)

(73) Assignee: Job Corporation, Yokohama-shi, Kanagawa (JP)

( * ) Notice: Subject to any disclaimer, the term of this patent is extended or adjusted under 35 U.S.C. 154(b) by 269 days.

(21) Appl. No.: 12/734,717

(22) PCT Filed: Mar. 3, 2009

(86) PCT No.: PCT/JP2009/053924

§ 371 (c)(1),
(2), (4) Date: May 19, 2010

(87) PCT Pub. No.: WO2009/110447

PCT Pub. Date: Sep. 11, 2009

(65) Prior Publication Data

US 2010/0310053 A1 Dec. 9, 2010

(30) Foreign Application Priority Data

Mar. 4, 2008 (JP) ..... 2008-054078
Feb. 24, 2009 (JP) ..... 2009-041025

(51) Int. Cl.
*H05G 1/10* (2006.01)

(52) U.S. Cl. ..... 378/101

(58) Field of Classification Search ..... 378/101, 378/119, 121, 122
See application file for complete search history.

(56) References Cited

U.S. PATENT DOCUMENTS 6,836,534 B2 12/2004 Carmena

FOREIGN PATENT DOCUMENTS

| | | | |
|---|---|---|---|
| JP | 60023998 | A | 2/1985 |
| JP | 61091910 | A | 5/1986 |
| JP | 10106791 | A | 4/1998 |
| JP | 2004520690 | T | 7/2004 |
| JP | 2007026800 | A | 2/2007 |
| JP | 2008053076 | A | 3/2008 |

*Primary Examiner* — Jurie Yun
(74) *Attorney, Agent, or Firm* — Jacobson Holman PLLC

(57) ABSTRACT

Provided is an X-ray irradiator which reduces the occurrence of discharge resulting from the difference in electric potential in the X-ray irradiator, and which concurrently achieves reduction in size and weight. In an X-ray irradiator (1), an X-ray tube (11) and a high-voltage generator (2) are installed inside a casing (18), and an insulation oil (13) is filled in the casing (18). The high-voltage generator (2) is configured by arranging and electrically connecting together multiple ring-shaped voltage amplifying units (21). An anode (14) and a cathode (15) of the X-ray tube (11) are fitted in and thus installed in hollow portions of the voltage amplifying units (21).

6 Claims, 8 Drawing Sheets

Prior art

Prior art

X-RAY IRRADIATOR

This is a national stage of PCT/JP09/053924 filed Mar. 3, 2009 and published in Japanese, which has a priority of Japanese no. 2008-054078 filed Mar. 4, 2008 and Japanese no. 2009-041025 filed Feb. 24, 2009, hereby incorporated by reference.

TECHNICAL FIELD

The present invention relates to an X-ray irradiator, and specifically an X-ray irradiator used for a non-destructive inspection in which specimens such as food and industrial products are irradiated with an X-ray to detect a foreign material and a defect in the specimens on the basis of an amount of X-ray transmission. In addition, the present invention relates to an X-ray irradiator used for an inspection in the field of medicine.

BACKGROUND ART

A type of an X-ray irradiator including an X-ray tube, a high-voltage power supply, and a power supply for lighting a filament is most widely used among various types of X-ray irradiators. A high voltage of 10 kV to 500 kV depending on use is applied to the X-ray tube. Once the filament is lit, thermal electrons are emitted from a cathode part of the X-ray tube. The thermal electrons are accelerated by the high voltage, and thus collide against an opposed anode part. An X-ray is generated from energy produced by this collision. In the conventional X-ray generators, the X-ray tube and the high-voltage power supply, which is placed outside the X-ray tube, are connected with connectors. In the case of the connectors used for a high voltage, a sufficient creepage distance needs to be secured to prevent the discharge. For instance, when the voltage is 50 kV, 100 kV, or 200 kV, the connectors need to be as large as approximately 100 mm, 200 mm or 300 mm, respectively. Thus, it has been difficult to deal with these connectors.

With this taken into consideration, as shown in FIG. 8, a growing number of X-ray irradiators 1X have employed a configuration termed as a mono-block or mono-tank configuration in which an X-ray tube 11 and a high-voltage generator 2X are placed in the casing 18 filled with an insulation oil 13 or an insulation resin.

An X-ray irradiator 1X of this type uses the X-ray tube 11, which is called a neutral grounded type. The X-ray irradiator 1X or the like for checking the quality of IC chips or cast products is used with a voltage of 160 KV in total applied between an X-ray tube anode 14 and an X-ray tube cathode 15, that is, with 80 kV applied to the anode 14 and −80 kV applied to the cathode 15. There are various other voltage application methods for the X-ray tube 11, such as: the X-ray irradiator 1X in which different voltages are applied; the X-ray irradiator 1X in which a positive high-voltage is applied to the anode 14 while the electric potential of the cathode 15 is kept at zero; and the X-ray irradiator 1X in which a negative high-voltage is applied to the cathode 15 while the electric potential of the anode 14 is kept at zero.

The X-ray tube 11 emits scattered X-rays, which are produced inside the X-ray tube 11, from not only an X-ray irradiation window 17 but also every peripheral part of the X-ray tube 11. For this reason, the X-ray tube 11 is encircled with an insulation cylinder 32, and moreover, is encircled with an X-ray shielding member 16 on top thereof. The X-ray shielding member 16 uses lead in many cases. The X-ray shielding member 16 is fixed at zero electric potential, namely an earth potential. The X-ray irradiation window 17, provided to the X-ray tube 11 by removing a part of the X-ray shielding member 16, is a portion through which an X-ray is emitted to the outside of the X-ray tube 11. The X-ray irradiation window 17 uses beryllium or the like, which is excellent in X-ray transmission property.

In addition, the insulation oil 13 in the X-ray irradiator 1X is used for insulation from the high voltage, and for discharge of heat, which is generated from the X-ray tube 11, to the outside of the X-ray irradiator 1X through conduction of the heat to the casing 18 by convection (see Patent Document 1, for instance).

The high-voltage generator 2X, which employs a voltage generating transformer for generating several kV and multiple connected Cockcroft-Walton circuits 23 shown in FIG. 6A, is used in many cases. In each Cockcroft-Walton circuit 23, capacitors 24 and diodes 25 are arranged in a ladder-like manner. Thus, the Cockcroft-Walton circuit 23 has a function of generating a direct-current high voltage with application of an alternating-current voltage $V_{AC}$, by amplifying the applied voltage $V_{AC}$ approximately twice to twenty times due to both the charging effects of the capacitors 24 and the rectifying effects of the diodes 25.

Patent Document 1: Japanese Patent Application Kokai Publication No. 2007-26800.

DISCLOSURE OF THE INVENTION

Problems to be Solved by the Invention

FIG. 9 shows an example of the distribution of voltage in the conventional X-ray irradiator 1X. The cylinder-shaped X-ray shielding member 16 is at the earth potential, whereas 80 kV is applied to the X-ray tube anode 14. For this reason, the difference in electric potential between the X-ray tube anode 14 and the X-ray shielding member 16 is so large that discharge is highly likely to occur.

To put it specifically, although the X-ray tube 11 is covered with the insulation cylinder 32 additionally with the insulation oil 13 filled therearound, the conventional X-ray has a problem that, once 80 kV is applied to the X-ray tube anode 14 whereas −80 kV is applied to the X-ray tube cathode 15, discharge may occur between the X-ray tube anode 14 or the X-ray tube cathode 15, and the X-ray shielding member 16 which is at zero electric potential. This type of discharge becomes more serious as the applied voltages become higher.

Many locations similarly having a large electric potential difference exist inside the X-ray irradiator 1X. In addition, the voltage around the X-ray tube 11 is at zero electric potential. For these reasons, the voltage inside the X-ray tube 11 sometimes becomes unstable, and accordingly internal discharge occurs in the X-ray tube 11 in some cases. Due to this, the X-ray irradiator 1X has a problem of unstable operation.

The present invention has been made to solve the above-described problems. An object of the present invention is to provide an X-ray irradiator which reduces the occurrence of discharge resulting from differences in electric potential, and which concurrently achieves reduction in size and weight.

Means for Solving the Problems

An X-ray irradiator according to the present invention for achieving the above object is an X-ray irradiator having an X-ray tube and a high-voltage generator installed inside a casing, and having an insulation oil filled in the casing, the X-ray irradiator characterized in that the high-voltage generator is configured by arranging and electrically connecting together a plurality of ring-shaped voltage amplifying units, and an anode and a cathode of the X-ray tube are fitted in and thus installed in hollow portions respectively of the voltage amplifying units.

The above X-ray irradiator is characterized in that each of the voltage amplifying units includes an insulator and a voltage amplifying circuit formed of a Cockcroft circuit installed on the insulator.

The above X-ray irradiator is characterized in that a plate-shaped or ring-shaped auxiliary electric potential plate is installed between the X-ray tube and the casing, and the auxiliary electric potential plate is configured to prevent discharge from occurring between the X-ray tube and the casing, with application of an electric potential intermediate between electric potentials of the X-ray tube and the casing.

The above X-ray irradiator is characterized in that the insulator includes a ring-shaped bottom plate as well as cylinder-shaped sidewalls installed along inner and outer peripheries of the bottom plate, the voltage amplifying circuit is installed in a concave portion surrounded by the bottom plate and the two sidewalls, and X-ray shielding members are placed in the two respective sidewalls.

Effects of the Invention

In an X-ray irradiator according to the present invention, a high-voltage generator is configured by connecting together multiple ring-shaped voltage amplifying units which are arranged to be fitted to an X-ray tube. The configuration enables a voltage to be stepwise applied to the X-ray irradiator. This makes it possible to minimize the difference in electric potential in the X-ray irradiator, and thus to prevent occurrence of discharge. Furthermore, because the X-ray tube is fitted into the hollow portions of the respective multiple ring-shaped voltage amplifying units, it is possible to integrally configure the X-ray tube and the high-voltage generator, which have been separately placed under the prior art. This allows reduction in size of the X-ray irradiator. For this reason, the X-ray irradiator according to the present invention can be made approximately half the size of the conventional X-ray irradiator.

Moreover, the high-voltage generator includes the multiple voltage amplifying units. For this reason, the high-voltage generator is capable of changing the amount of voltage amplification by increasing or decreasing the number of the voltage amplifying units. Under the prior art, for each X-ray tube which needs a voltage different from that of any other X-ray tube, a high-voltage generator which meets the requirement for the amount of voltage amplification is constructed. On the contrary, the present invention makes it possible to change the number of voltage amplifying units combined together, and accordingly change the voltage to be amplified. For this reason, the high-voltage generator configured by combining voltage amplifying units together enhances its use versatility, and can contribute to the standardization of high-voltage generators.

Moreover, because the X-ray irradiator is configured in a manner that the plate-shaped or ring-shaped auxiliary electric potential plates are installed between the X-ray tube and the casing, it is possible to prevent the occurrence of the discharge between the electric potential of the high-voltage generator and the zero electric potential of the casing. The discharge can be prevented by applying a voltage to these auxiliary electric potential plates in order to ease the difference in electric potential between the high-voltage generator and the casing, and preferably by applying an average voltage, which corresponds to an average between the two electric potentials respectively of the high-voltage generator and the casing, to these auxiliary electric potential plates.

In addition, each insulator is configured in a manner that: the insulator includes the ring-shaped bottom plate as well as the cylinder-shaped sidewalls respectively installed along the inner and outer peripheries of the bottom plate; the voltage amplifying circuits are installed in the concave portion surrounded by the bottom plate and the two sidewalls; and the X-ray shielding members are placed in the respective two sidewalls. This configuration protects the voltage amplifying circuits from X-rays. Simultaneously, each voltage amplifying unit itself functions as an X-ray shielding member. For these reasons, the configuration of the insulator which is placed to cover the peripheries of the corresponding voltage amplifying unit and a corresponding portion of the X-ray tube plays a role of preventing the scatter of X-rays. Additionally, when insulators are placed between the X-ray tube and the voltage amplifying units, as well as between the X-ray tube and the casing, the occurrence of the discharge is capable of being prevented.

EXPLANATION OF REFERENCE NUMERALS

Figure 1:
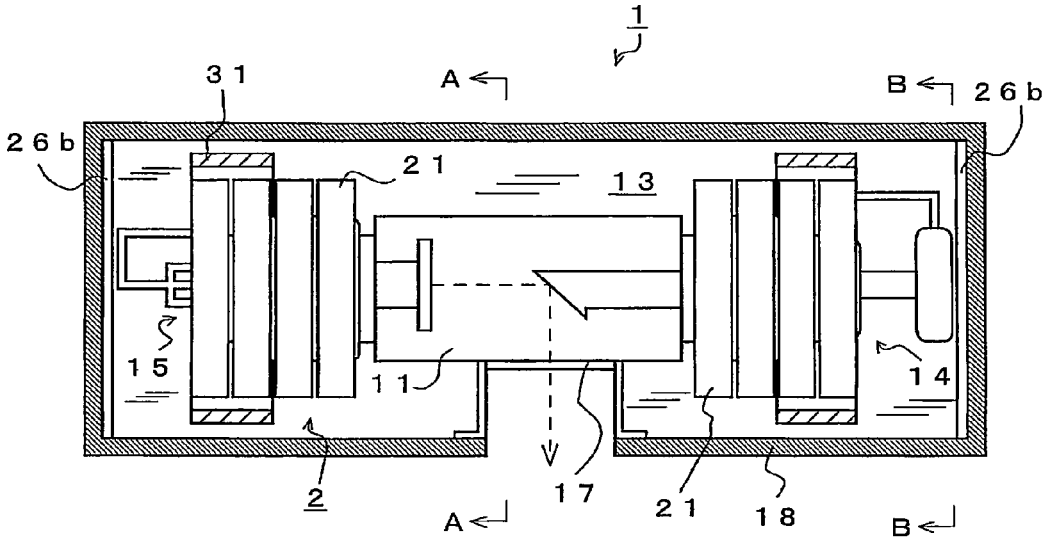
FIG. 1 is a schematic diagram of an X-ray irradiator according to an embodiment of the present invention.

| | |
|---|---|
| 1 | X-ray irradiator |
| 2 | high-voltage generator |
| 11 | X-ray tube |
| 13 | insulation oil |
| 14 | X-ray tube anode (anode) |
| 15 | X-ray tube cathode (cathode) |
| 16 | X-ray shielding member |
| 18 | casing |
| 21 | voltage amplifying unit |

-continued

| EXPLANATION OF REFERENCE NUMERALS | |
|---|---|
| 23 | Cockcroft-Walton circuit |
| 26 | insulator |
| 26b | insulator |
| 31 | auxiliary electric potential plate |

BEST MODES FOR CARRYING OUT THE INVENTION

Descriptions will be hereinbelow provided for the present invention, referring its embodiment as shown in the drawings.

FIG. 1 shows a schematic of an X-ray irradiator 1. In the X-ray irradiator 1, a cylinder-shaped X-ray tube 11 is installed inside a casing 18, and four voltage amplifying units 21 are installed around each of an X-ray tube anode (hereinafter referred to as an "anode") 14 and an X-ray tube cathode (hereinafter referred to as a "cathode") 15. A high-voltage generator 2 including the multiple voltage amplifying units 21 is connected to the anode 14 and the cathode 15, and is also connected to an unillustrated external power supply.

Auxiliary electric potential plates 31 are installed around the high-voltage generator 2. The auxiliary electric potential plates 31 are capable of reducing the difference in electric potential around the high-voltage generator 2, and accordingly preventing discharge. In addition, an insulation oil 13 or an insulation resin is filled in the casing 18. Insulators 26*b* may be installed between the anode 14 and the casing 18 opposed to the anode 14, as well as between the cathode 15 and the casing 18 opposed to the cathode 15, respectively.

Figure 8:
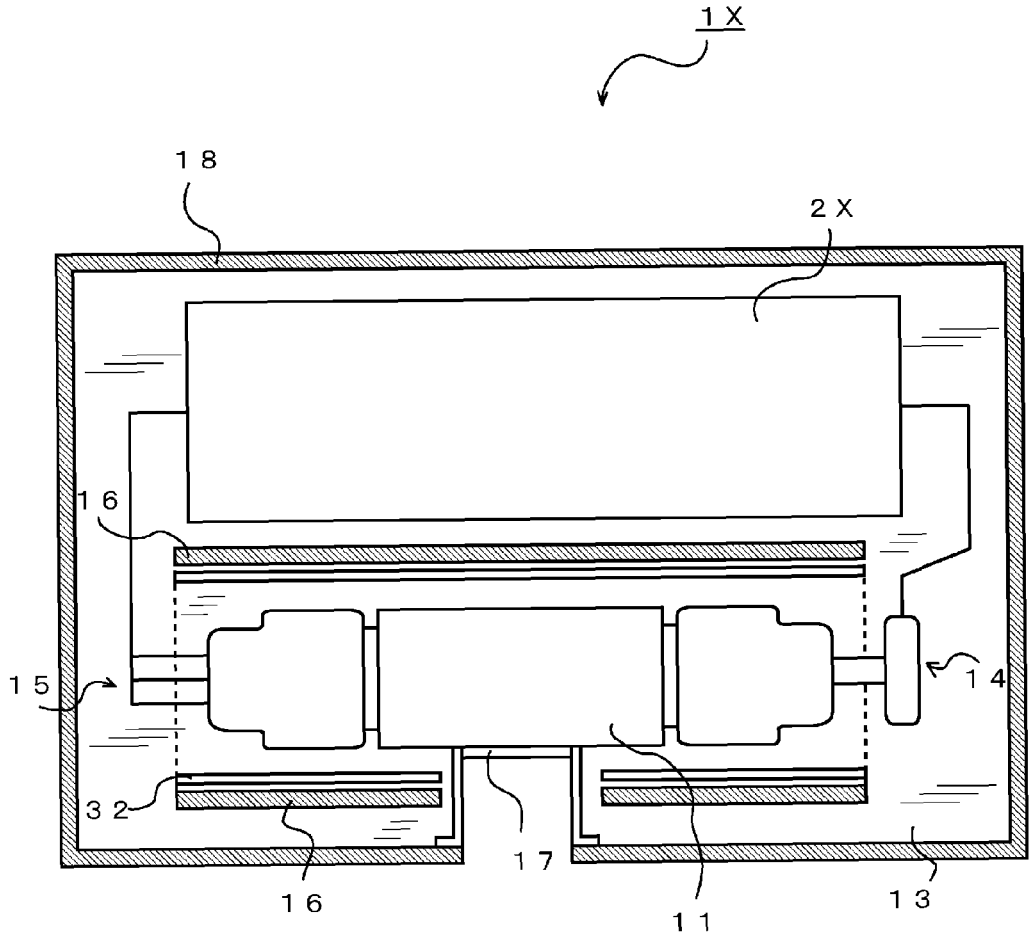
FIG. 8 is a schematic diagram of a conventional X-ray irradiator.
Figure 9:
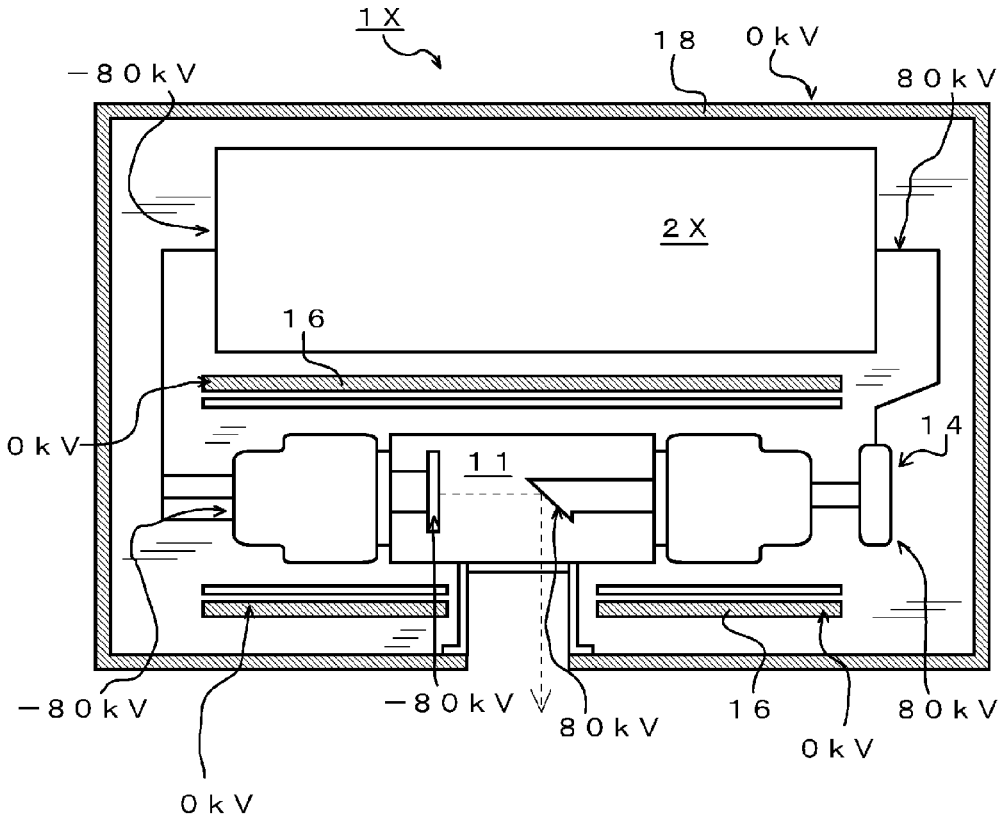
FIG. 9 is a schematic diagram of the distribution of electric potential in the conventional X-ray irradiator.

The X-ray irradiator 1 as shown in FIG. 1 no longer needs a space for the high-voltage generator 2X installed in the conventional X-ray irradiator 1X as shown in FIG. 8. For this reason, the X-ray irradiator 1 can achieve reduction in size. Simultaneously, the volume of the casing 18 is reduced. This reduction decreases the amount of insulation oil 13 filled inside the casing 18, thereby contributing to reduction in weight of the X-ray irradiator 1.

Furthermore, the X-ray irradiator 1 is configured in a manner that: the high-voltage generator 2 and X-ray shielding members 16 prevent leakage of X-rays applied from the X-ray tube 11; and an X-ray is accordingly capable of being applied only through an X-ray irradiation window 17 made of beryllium which is excellent in X-ray transmission property. Note that a broken line indicates an X-ray.

Figure 2:
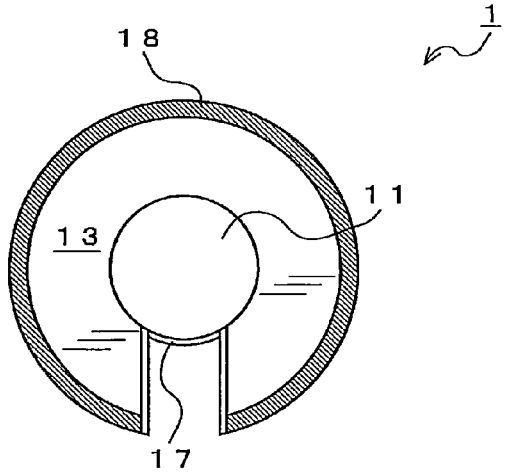
FIG. 2 is a cross-sectional view of the X-ray irradiator taken along a line A-A of FIG. 1.
Figure 3:
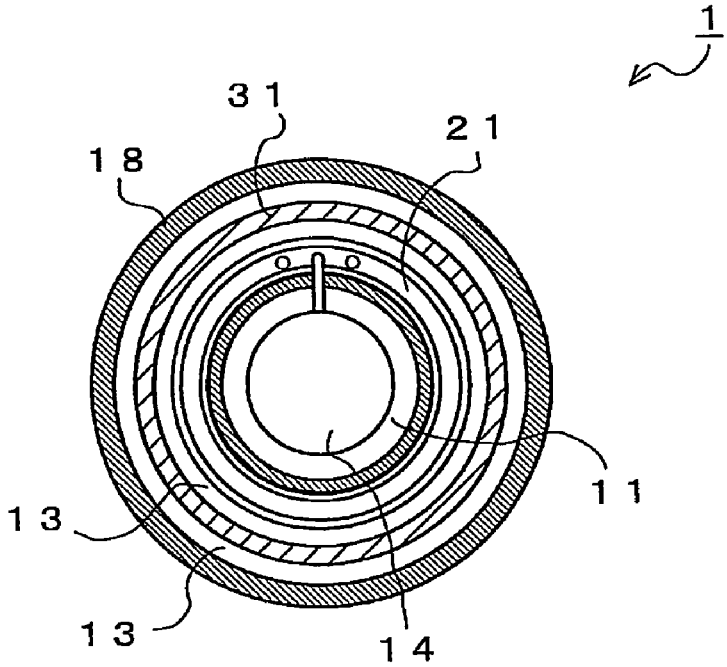
FIG. 3 is a view of the X-ray irradiator indicated by arrows B-B of FIG. 1.

FIG. 2 shows a cross-sectional view of the X-ray irradiator 1 taken along a line A-A of FIG. 1. FIG. 3 shows a perspective view of the X-ray irradiator 1 indicated by arrows B-B of FIG. 1. In this respect, the cross section of the X-ray irradiator 1 according to the present invention is shown as being shaped like a circle. However, the cross section of the X-ray irradiator 1 may be shaped like any other form such as a rectangle.

Figure 4:
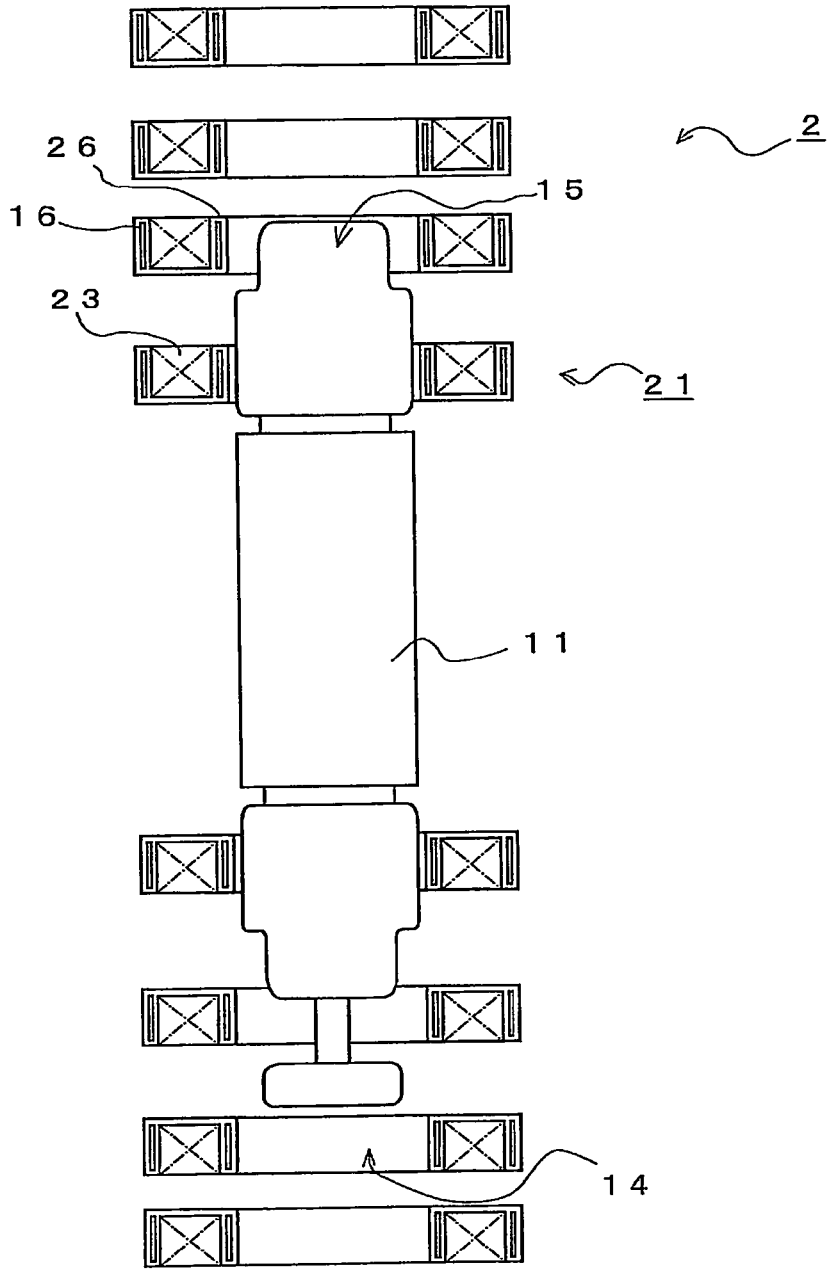
FIG. 4 is an exploded view of a high-voltage generator and an X-ray tube according to the embodiment of the present invention.

FIG. 4 show how the X-ray tube 11 and the high-voltage generator 2 are separated from each other. The high-voltage generator 2 includes the multiple voltage amplifying units 21, and is mounted on the periphery of the X-ray tube 11. Each voltage amplifying unit 21 is shaped like a ring, and is formed in a size which enables the voltage amplifying unit 21 to be installed around the anode 14 or the cathode 15 of the X-ray tube 11. An insulator 26 is mounted on the inner sidewall of each voltage amplifying unit 21. The main body of each voltage amplifying unit 21 is formed of the X-ray shielding members 16, which are made of lead or the like, and which are covered with the insulator 26.

Descriptions will be hereinbelow provided for the high-voltage generator 2 which is a main section of the X-ray irradiator 1 according to the embodiment of the present invention.

Figure 5A:
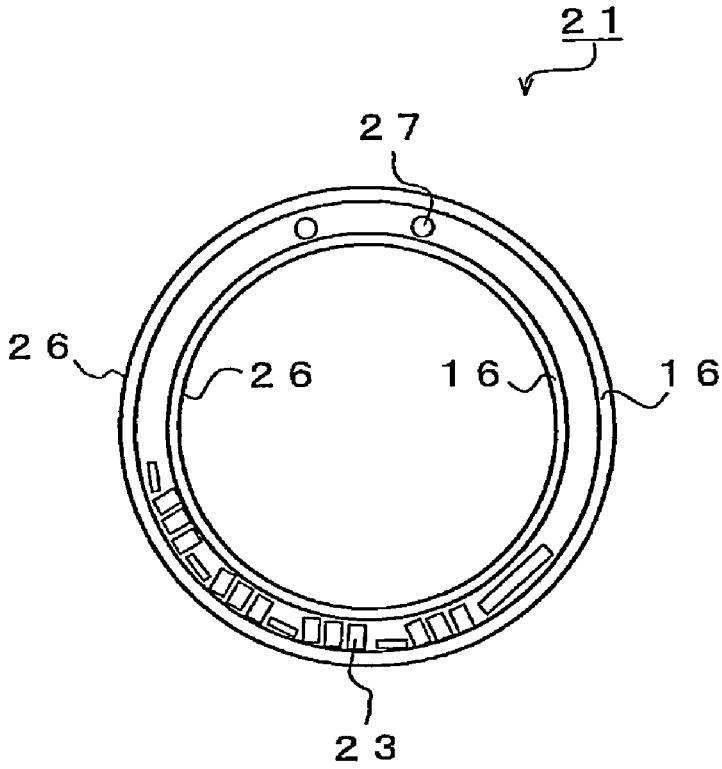
FIG. 5A is a plan view of the high-voltage generator according to the embodiment of the present invention.
Figure 5B:
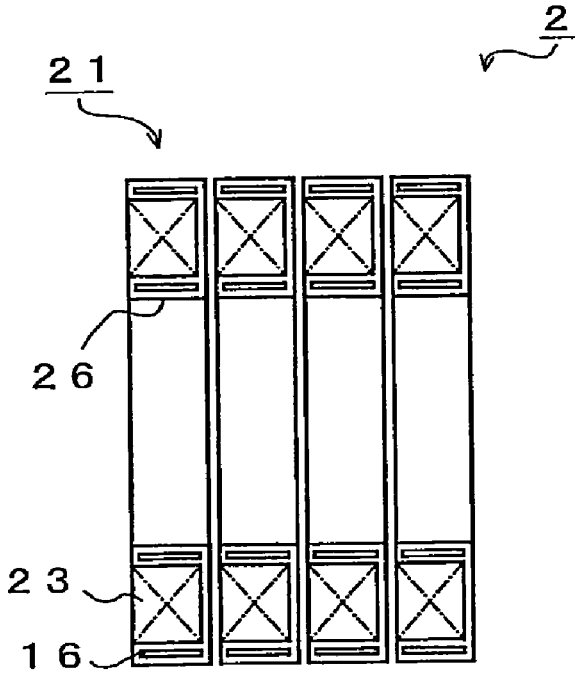
FIG. 5B is a side cross-sectional view of the high-voltage generator according to the embodiment of the present invention.
Figure 5C:
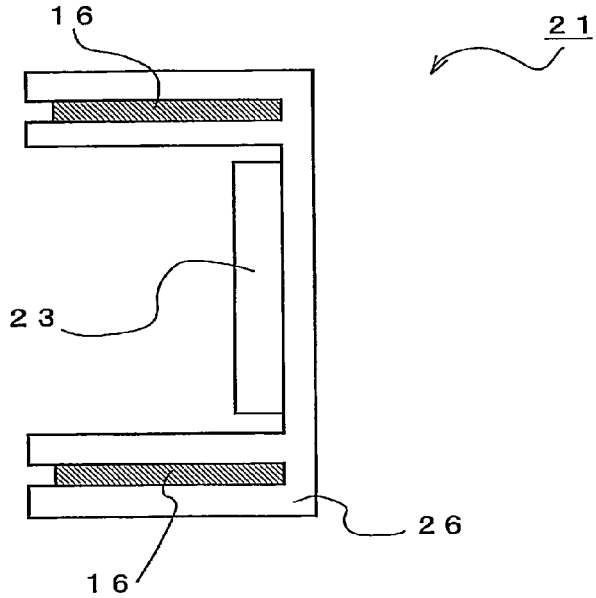
FIG. 5C is an enlarged view of a side cross section of the high-voltage generator according to the embodiment of the present invention.

FIG. 5A shows a plan view of one of the voltage amplifying units 21; FIG. 5B shows a side view of some of the voltage amplifying units 21; and FIG. 5C shows an enlarged view obtained by enlarging a part of one of the voltage amplifying units 21 as shown in FIG. 5B. Each voltage amplifying unit 21 is formed of the insulator 26 covering the X-ray shielding members 16 (shielding materials) made of lead or the like. The cross section of the voltage amplifying unit 21 is shaped as shown in FIG. 5C. The voltage amplifying unit 21 has a Cockcroft-Walton circuit 23, which is an example of a voltage amplifying circuit, in its concave portion. In this respect, each voltage amplifying unit 21 may have a configuration, for instance, in which the bottom plate and sidewalls of the concave portion are formed of the X-ray shielding member 16 instead of the insulator 26; and the insulator 26 is adhered onto this X-ray shielding member 16. Each voltage amplifying unit 21 only needs to be formed of the X-ray shielding member 16 and the insulator 26.

Each voltage amplifying circuit is capable of being protected from X-rays by its corresponding X-ray shielding members 16 made of lead or the like. In addition, the high-voltage generator 2 itself functions as an X-ray shielding member. For these reasons, it is possible to prevent X-rays from being scattered to the outside of the X-ray irradiator 1. At the same time, it is possible to make the amount of X-ray shielding members 16 installed inside the casing 18 smaller than ever before, thereby achieving reduction in size and weight of the X-ray irradiator 1. Furthermore, because each voltage amplifying unit 21 includes the insulator 26, it is possible for the voltage amplifying unit 21 to be less susceptible to the influence of the X-ray tube 11, to which the high voltage is applied. Accordingly, it is possible to prevent the discharge.

It should be noted that multiple voltage amplifying units 21 can be combined together by use of installation screw holes 27 as shown in FIG. 5A. Although not illustrated, the multiple voltage amplifying units 21 are electrically connected together.

In addition to the ring shape, various other shapes may be conceived as the shape of each voltage amplifying unit. Such shapes include: a shape representing halves of a ring obtained by bisecting the ring; and a shape which allows the X-ray tube 11 to pass through the center of the voltage amplifying unit as shaped like a rectangle. Moreover, although the high-voltage generator 2 is configured by connecting together the multiple voltage amplifying units 21, the high-voltage generator 2 may be instead configured by using a single cylinder-shaped voltage amplifying unit 21 for the purpose of only achieving reduction in size and weight of the X-ray irradiator 1.

Figure 6A:
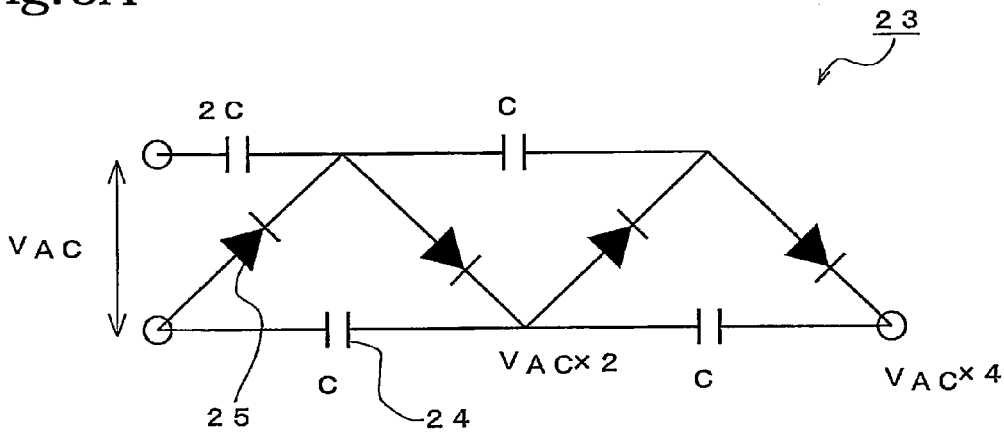
FIG. 6A is a circuit diagram of a Cockcroft circuit which is an example of a voltage amplifying circuit.

FIG. 6A shows a circuit diagram of the Cockcroft circuit 23 which is an example of the voltage amplifying circuit. FIG. 6A shows that once an alternating-current power supply $V_{AC}$ is applied to the circuit in which capacitors 24 and diodes 25 are arranged in a ladder-like manner, a voltage which is twice or four times as large as the applied voltage is obtained from the circuit. This Cockcroft circuit may be configured to amplify an alternating-current voltage $V_{AC}$ approximately twice to twenty times due to both the rectifying effects of the diodes and the charging effects of the capacitors 24, upon application of the alternating-current voltage $V_{AC}$. The present invention makes it possible to obtain the same effect even if any other type of voltage amplifying circuit is used.

Figure 6B:
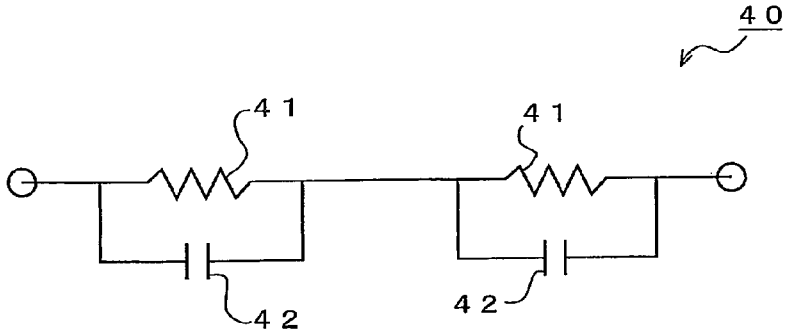
FIG. 6B is a circuit diagram of a voltage detecting circuit for negative feedback control.

FIG. 6B shows a high-voltage detecting circuit 40 for negative feedback control in which detection resistors 41 and capacitors 42 for compensating the detection characteristics are respectively connected together in parallel.

Figure 6C:
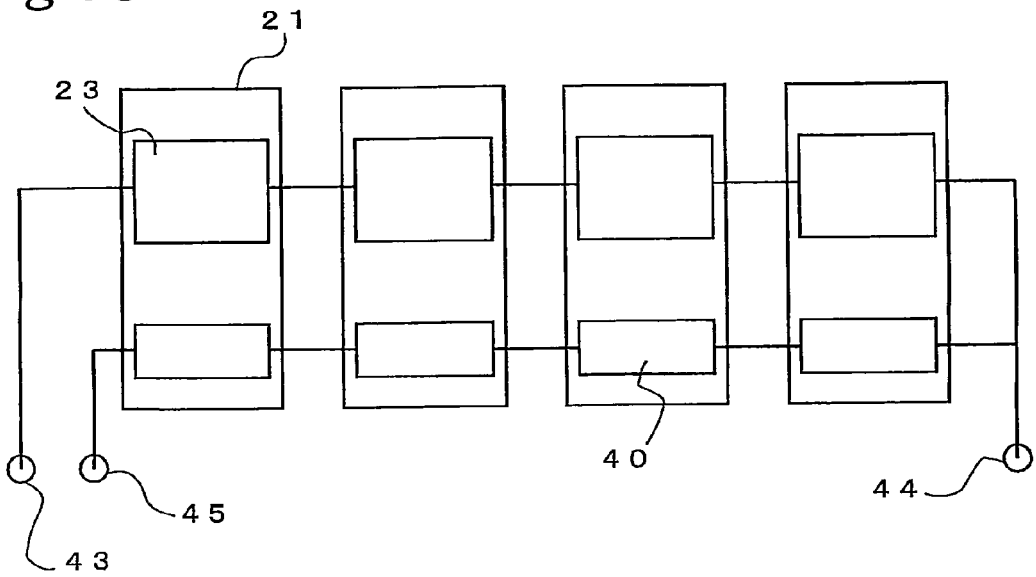
FIG. 6C is a diagram of a circuit built in the high-voltage generator according to the embodiment of the present invention.

FIG. 6C shows how the Cockcroft circuit 23 and the high-voltage detecting circuit 40 for negative feedback control are arranged in each voltage amplifying unit 21. Note that: reference numeral 43 denotes an input; reference numeral 44 denotes an output; and reference numeral 45 denotes a negative feedback current. In the circuit as a whole, a series circuit of the Cockcroft circuit 23 and a series circuit of the high-voltage detecting circuits 40 each for negative feedback control are connected together in parallel. The high-voltage detecting circuits 40 each for negative feedback control are circuits that detect a voltage at the output 44, and that feeds back the condition of the detected voltage to the input 43. An electric current of this feedback circuit enables a voltage outputted by the high-voltage generator 2 to be kept constant by using an unillustrated comparator amplifier that compares the outputted voltage with a reference voltage.

Figure 7:
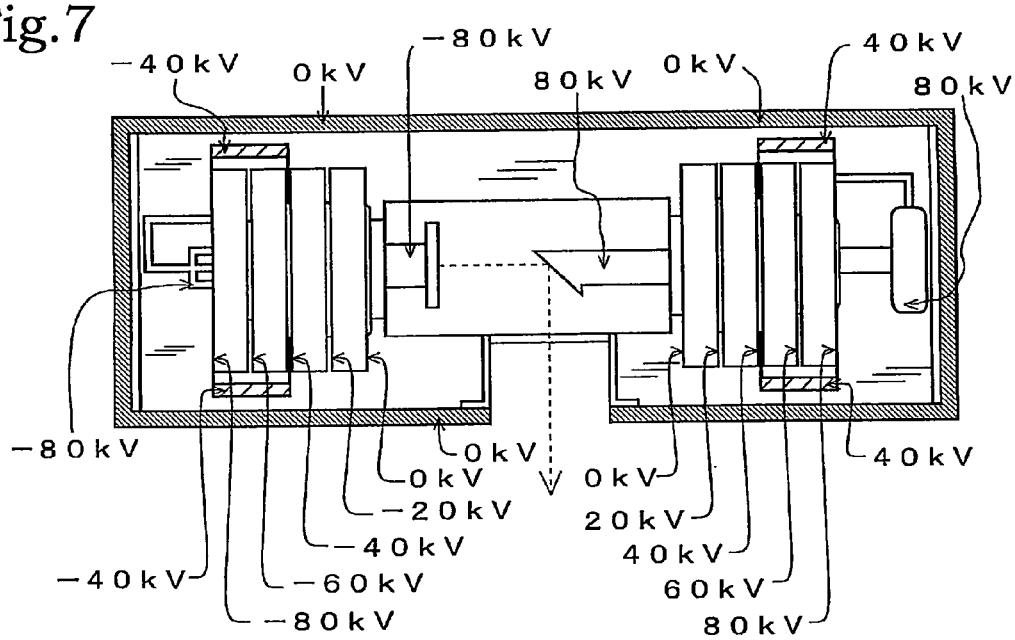
FIG. 7 is a schematic diagram showing the distribution of electric potential in the X-ray irradiator according to the present invention.

FIG. 7 shows an example of how voltages are distributed in the X-ray irradiator 1. Note that alphabets A to I denote the respective voltages in the X-ray irradiator 1.

When 80 kV or −80 kV is applied to the X-ray tube anode 14 or the X-ray tube cathode 15 by using four voltage amplifying units 21, the voltage application is achieved as follows. A voltage is applied to the anode in such a stepwise manner that: the voltage amplifying units 21 amplify the voltage from 0V to 20 kV in the first stage; from 20 kV to 40 kV in the second stage; from 40 kV to 60 kV in the third stage; and from 60 kV to 80 kV in the fourth stage. Similarly, the voltage is applied to the cathode.

In this respect, the X-ray irradiator 1 according to the embodiment of the present invention is configured in a manner that: four voltage amplifying units 21 are used for each of the anode and the cathode; and the high-voltage generator 2 is accordingly constructed as a four-staged high-voltage generator. Instead, however, the amount of voltage amplification can be increased or decreased by increasing or decreasing the number of voltage amplifying units 21. In addition, the gradient of the electric potential can be made gentler with a reduction in the amount of voltage amplified by each voltage amplifying unit 21, and an increase in the number of voltage amplifying units. In other words, it is possible to prevent the discharge by reducing the difference in electric potential between each neighboring two points in the X-ray irradiator 1. In addition, it is possible to prevent the discharge by reducing the difference in electric potential in the high-voltage generator 2, too.

The cross-sectional shape of each of the voltage amplifying units 21 and the casing 18 may be freely selected from a rectangular shape, a circular shape and the like. However, it is desirable that the cross-sectional shape thereof should be circular. When the cross-sectional shape thereof is circular, it is possible to makes the distribution of electric potential in each voltage amplifying unit 21 and the distribution of electric potential inside the casing 18 almost completely round and concentric with each other. The almost complete roundedness and concentricity greatly enhances the homogeneity in the electric potential, and accordingly enhances the discharge preventing effect.

In the X-ray irradiator 1, when the anode part is at 80 kV, some of the X-ray shielding members are at 0 kV. However, others of the X-ray shielding members are at 20 kV; yet others are at 40 kV; and still others are at 60 kV. In this manner, the differences in electric potential in most areas of the X-ray irradiator 1 are less than those of the conventional X-ray irradiator. This largely lowers the probability of the occurrence of the discharge extremely, thereby allowing provision of a stably-operable X-ray irradiator 1.

Further, the ring-shaped or plate-shaped auxiliary electric potential plates 31 are installed between the high-voltage generator 2 and the X-ray shielding members 16. By applying a voltage to these auxiliary electric potential plates 31, the difference in electric potential inside the X-ray irradiator 1 decreases, and thereby a higher effectiveness for preventing the discharge can be obtained.

In the conventional X-ray irradiator, the difference in electric potential is 80 kV between the X-ray tube anode 14 and the casing 18 or the X-ray shielding member 16, or between other similar locations. When an intermediate voltage of 40 kV is applied to the auxiliary electric potential plate 31 installed at the side of the X-ray tube anode 14, the 40 kV of the auxiliary electric potential 31 is added between the 80 kV of the X-ray tube anode 14 and the 0V of the casing 18. Thus, the maximum difference in electric potential is reduced to 40 kV, which is a half of the maximum difference in electric potential in the conventional X-ray irradiator.

In this respect, it desirable to place each auxiliary electric potential plate 31 away from the voltage amplifying units 21 with a uniform gap. When the voltage amplifying units 21 are shaped like a ring, for example, it is desirable to shape each auxiliary electric potential plate 31 like a ring. Furthermore, because each auxiliary electric potential plate 31 is used to make the distribution of electric potential inside the X-ray irradiator 1 more homogeneous, it is more efficient that the auxiliary electric potential plate 31 is installed corresponding to only the third and fourth stages, as shown in FIG. 7. However, the installation place is not limited to this example. The installation place may be changed depending on a voltage applied to the auxiliary electric potential plate 31.

Moreover, as clear from a comparison between FIG. 1 and FIG. 8, the X-ray irradiator 1 employing the high-voltage generator 2 according to the present invention can be made smaller in size, as a whole, to approximately half of the X-ray irradiator 1X installed with the conventional high-voltage generator 2X. In addition, the weight of the X-ray irradiator 1 can be reduced from 50 kg to 30 kg.

The present invention can provide the X-ray irradiator 1 which prevents the discharge inside the X-ray irradiator 1, and which achieves stability in operation as well as reduction in size and weight. In addition, since achieving much greater reduction in size and weight than the conventional X-ray irradiator 1X, the X-ray irradiator 1 makes it easy to apply an X-ray inspection to large animals including livestock or the like such as cows and horses.

What is claimed is:

1. An X-ray irradiator comprising:

an X-ray tube having an anode and a cathode, a casing filled with an insulation oil, a plurality of ring-shaped voltage amplifying units having hollow portions, and a high-voltage generator installed inside the casing, wherein the high-voltage generator is configured by arranging and electrically connecting together the plurality of ring-shaped voltage amplifying units, and wherein the anode and the cathode of the X-ray tube are fitted and installed in the hollow portions of the voltage amplifying units.

2. The X-ray irradiator according to claim 1, wherein each of the voltage amplifying units includes an insulator and a voltage amplifying circuit formed of a Cockcroft circuit installed on the insulator.

3. The X-ray irradiator according to claim 2, further comprising an auxiliary electric potential plate installed between the X-ray tube and the casing, wherein the auxiliary electric potential plate is one of plate-shaped and ring-shaped, and is configured to prevent discharge from occurring between the X-ray tube and the casing, with application of an electric potential intermediate between electric potentials of the X-ray tube and the casing.

4. The X-ray irradiator according to claim 2, wherein:

the insulator includes a ring-shaped bottom plate having inner and bottom peripheries, and cylinder-shaped inner and outer sidewalls installed along the inner and outer peripheries, respectively, of the bottom plate, the bottom plate and the inner and outer sidewalls surround a concave portion, the voltage amplifying circuit is installed in the concave portion surrounded by the bottom plate and the inner and outer sidewalls, and the X-ray irradiator further comprises X-ray shielding members placed in the inner and outer sidewalls.

5. The X-ray irradiator according to claim 1, further comprising an auxiliary electric potential plate installed between the X-ray tube and the casing, wherein the auxiliary electric potential plate is one of plate-shaped and ring-shaped, and is configured to prevent discharge from occurring between the X-ray tube and the casing, with application of an electric potential intermediate between electric potentials of the X-ray tube and the casing.

6. The X-ray irradiator according to claim 5, wherein:

the insulator includes a ring-shaped bottom plate having inner and bottom peripheries, and cylinder-shaped inner and outer sidewalls installed along the inner and outer peripheries, respectively, of the bottom plate, the bottom plate and the inner and outer sidewalls surround a concave portion, the voltage amplifying circuit is installed in the concave portion surrounded by the bottom plate and the inner and outer sidewalls, and the X-ray irradiator further comprises X-ray shielding members placed in the inner and outer sidewalls.

* * * * *